United States Patent [19]

Collins et al.

[11] Patent Number: 4,918,460

[45] Date of Patent: Apr. 17, 1990

[54] TELESCOPIC MAST WITH A REEL FOR WINDING SETS OF STAYS

[75] Inventors: Brian S. Collins, Sittingbourne; Reginald F. Batters, Maidstone; Mervyn Brameld, Gillingham, all of United Kingdom; Timothy Price, Vienna, Va.

[73] Assignee: C&S Antennas Limited, United Kingdom

[21] Appl. No.: 238,658

[22] Filed: Aug. 31, 1988

[30] Foreign Application Priority Data

Sep. 2, 1987 [GB] United Kingdom ..... 8720658
May 27, 1988 [EP] European Pat. Off. ..... 88304842.3

[51] Int. Cl.[4] ..... H01Q 1/12

[52] U.S. Cl. ..... 343/877; 343/883; 343/901

[58] Field of Search ..... 343/877, 880, 883, 890, 343/901, 915

[56] References Cited

U.S. PATENT DOCUMENTS

| | | | |
|---|---|---|---|
| 959,100 | 5/1910 | Von Arco | 343/880 |
| 2,890,902 | 6/1959 | Gindre | 287/54 |
| 2,983,342 | 5/1961 | Howard | 343/883 |
| 3,189,906 | 6/1965 | Kulik et al. | 343/877 |
| 3,380,059 | 4/1968 | Pearlman | 343/880 |
| 3,950,756 | 4/1976 | Tisler | 343/877 |
| 4,047,821 | 9/1977 | Hoke et al. | 403/109 |
| 4,212,015 | 7/1980 | Graf et al. | 343/883 |

FOREIGN PATENT DOCUMENTS

| | | | |
|---|---|---|---|
| 2461885 | 3/1976 | Fed. Rep. of Germany . | |
| 2552918 | 6/1977 | Fed. Rep. of Germany . | |
| 3338919 | 5/1985 | Fed. Rep. of Germany . | |
| 1141181 | 3/1957 | France . | |
| 2303980 | 10/1975 | France . | |
| 2317538 | 7/1976 | France . | |
| 104388 | 3/1917 | United Kingdom . | |
| 755053 | 8/1956 | United Kingdom . | |
| 1119042 | 7/1968 | United Kingdom . | |
| 1121160 | 7/1968 | United Kingdom . | |
| 1180776 | 2/1970 | United Kingdom . | |
| 1266359 | 3/1972 | United Kingdom . | |
| 1514962 | 6/1978 | United Kingdom . | |
| 2075567 | 11/1981 | United Kingdom . | |
| 2109637 | 6/1983 | United Kingdom | 343/877 |

*Primary Examiner*—Rolf Hille
*Assistant Examiner*—Doris J. Johnson

[57] ABSTRACT

A telescopic mast is provided in kit form with stays wound on reels in a predetermined order. This order is such that when erecting the mast it is only necessary to walk between the mast and pegs fixed into the ground and not between two pegs at a distance from the mast. This minimizes the amount of walking which is necessary in erecting the mast. Clamps between sections are formed from a strap around the outer of two concentric sections. The ends of the strap are secured together and attached to a member with a pressure face. A camming device between this member and the mast which acts against the pressure face and the mast enables the strap to be tightened thus gripping the outer mast portion against the inner mast portion. The top section of a telescopic mast is less inherent rigidity than the bottom section and this it is preferable to construct it from material with a greater resistance to longitudinal bending than the lower section and to vary the resistance of the intermediate sections accordingly.

4 Claims, 10 Drawing Sheets

TELESCOPIC MAST WITH A REEL FOR WINDING SETS OF STAYS

BACKGROUND OF THE INVENTION

This invention relates to telescopic masts, particularly to masts of the kind which may for example be used to mount antennas for mobile receivers and transmitters.

Such masts require stays to stabilise them and hold them in a vertical position. The arrangement of these stays in the erection of a mast can be a time consuming process.

Furthermore, when the mast is erected, the downward component of the force exerted by the stays tends to cause the mast to collapse. Locking mechanism on each telescopic section prevent this, but they typically require the tightening of nuts and bolts which is again time consuming. Manually operated clamps to hold extended sections in position are known in masts such as the Racal RA 456 mast. However, these lock onto the lower end of an extended section to prevent it sliding into the next lower section and are somewhat bulky since the clamp must provide a considerable overlap around the circumference of the section.

SUMMARY OF THE INVENTION

According to one aspect of the present invention there is provided a telescopic mast comprising a plurality of concentric portions slidable one within the other. The innermost portion is formed from material having the greatest resistance to longitudinal bending and the outermost portion from material having the least resistance to longitudinal bending.

According to another aspect of the invention the mast includes clamping means around an outer portion of each pair of adjacent concentric portions. The clamping means comprises a strap around the outer portion, the ends being held in a securing means to form a closed loop. A camming means is located between the securing means and the mast and is movable between a disengaged position in which the strap is loosened to permit relative longitudinal movment of the portions, and an engaged portion in which the securing means is urged away from the pair of adjacent portions thereby tightening the strap and compressing the outer portion against the inner portion.

According to a further aspect of the invention, stays for supporting the mast are provided on one or more reels, each reel having at least two sets of stays wound alternately on the reels. The order in which the stays are wound facilitates a method of erecting the mast in which the amount of walking between the mast and the pegs for holding the stays is minimised.

BRIEF DESCRIPTION OF THE DRAWINGS

This invention is now described in more detail by way of example, with reference to the drawings in which.

A mast embodying the invention can be made in any desired length and a 12 meter and a 15 meter mast are described here.

DETAILED DESCRIPTION OF PREFERRED EMBODIMENTS

Figure 1:
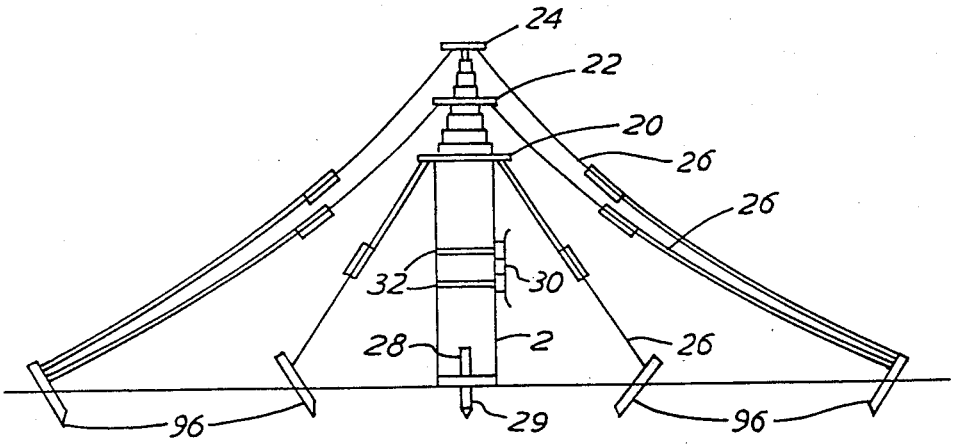
FIG. 1 is a schematic view of a 12 meter mast embodying the invention with supporting stays in position but with the mast in its collapsed state.
Figure 2:
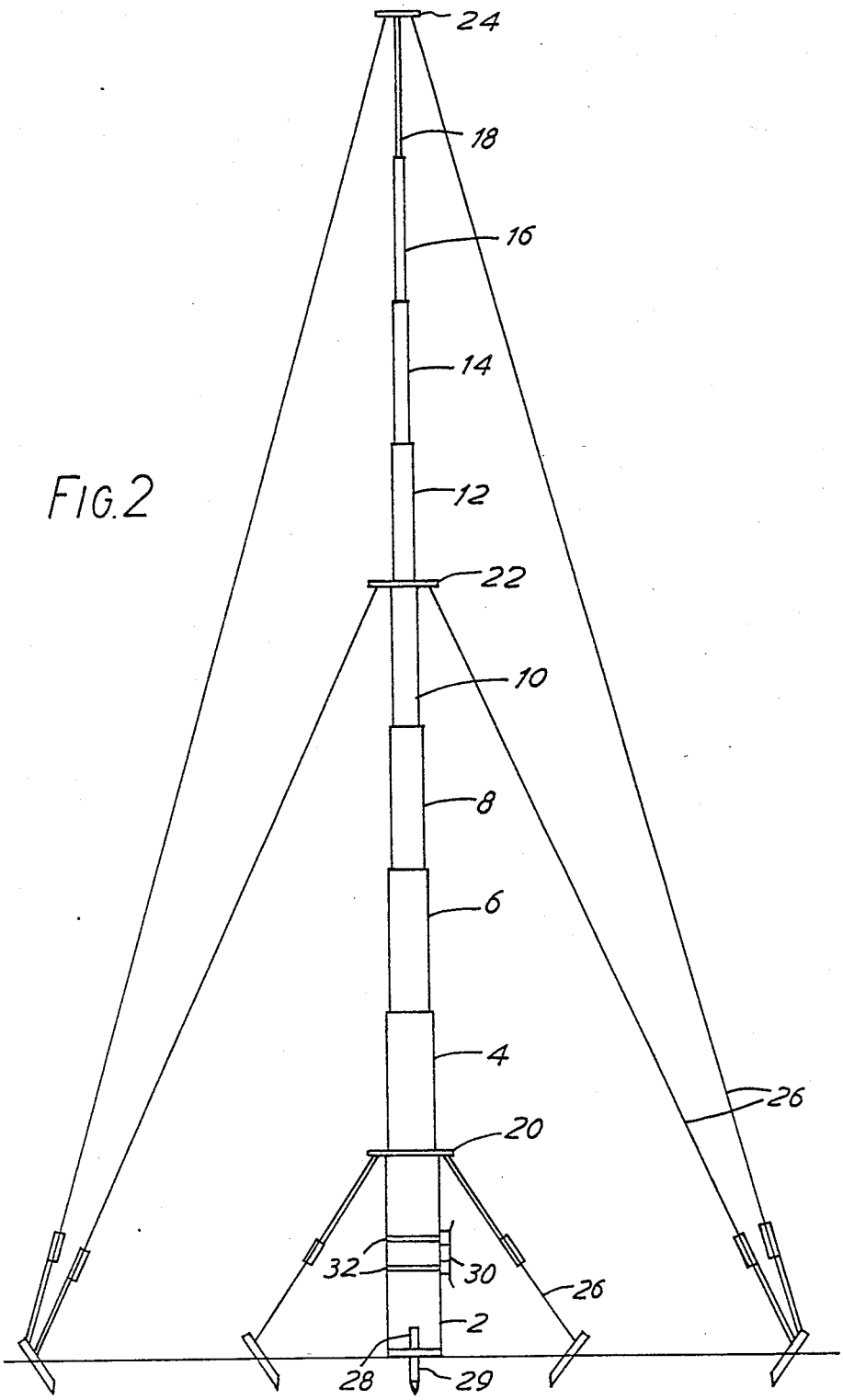
FIG. 2 shows the mast of FIG. 1 fully erected.

The mast illustrated in FIGS. 1 and 2 is a 12 meter mast and comprises nine telescopic sections 2, 4, 6, 8, 10, 12, 14, 16, 18, which slide one within another, the base section 2 being 73 mm in diameter and the top section 18 being 36 mm in diameter. The sections are of increasing length, the top two sections 16 and 18, being the longest and of substantially the same length, and the bottom section 2 being the shortest. The sections each protrude from the top of each of their respective next outer sections in the stowed mast to allow a clamping device (not shown in FIGS. 1 and 2) to be fitted to each section, apart from the top section, without having to remove the clamping devices from the stowed mast. The increasing lengths of the sections 2–18 ensures that there is no wasted storage space at the base of the mast. The clamping devices operate by compressing each respective outer mast section as will be described in more detail below.

The base section 2, the central section 10 and the top section 18 of the 12 meter mast are each fitted with respective rotatable stay plates 20, 22 and 24 to which are clipped stays 26. The stay plates are made from aluminium heat treated to reduce the risk of brittle fracture.

The base section of the mast has an axial hole 28 at its lower end which will locate over a spike 29 drive into the ground. A handle 30 is fixed by straps 32 around the base section 2 to enable the mast to be carried when collapsed. The handle 30 is located at the level of the centre of gravity of the collapsed mast. The lower end of the base section is preferably flared to create a larger base area for the mast.

Figure 3:
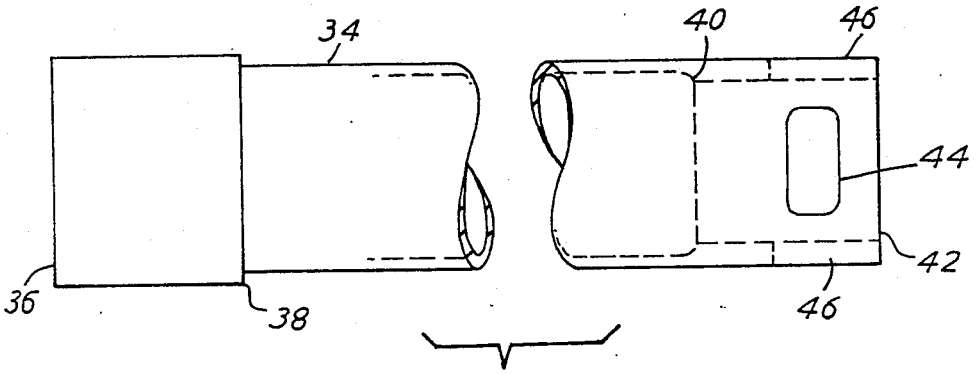
FIG. 3 shows a side view of a telescopic section of the mast of FIGS. 1 and 2.

A side view of a typical one of the mast sections 34 is shown in FIG. 3. The lower end 36 of the section is constructed with an elongate external flange 38. The flange engages an opposing internal abutment 40 in the top end 42 of the corresponding next outer mast section which the mast section 34 slides within. The flange 38 and abutment 40 provide a substantial overlap between both sections when engaged, so that the rigidity of the mast is not significantly reduced. A rectangular through slot 44 is provided in the overlapping section of the top end of the mast section. This enables a clamping device to directly engage the respective mast section at this position as will be described below. Preferably one or more longitudinal open-ended slots 46 are also provided in the top end 42 of the mast section to facilitate compression of the outer mast section against the inner mast section by the clamping device.

The mast sections are manufactured from a carbon/-glass reinforced plastic laminate to increase their resistance to longitudinal bending whilst minimising the weight of the mast. The upper sections of the mast are of the smallest diameter and thus are inherently less rigid than the lower sections. The sections therefore need to be constructed from material of varying resistance to bending. In the laminate of the upper sections a greater thickness of carbon is therefore employed than in the lower sections. In the 12 meter mast described here only the top four sections have carbon in them, the lower sections being sufficiently rigid for a mast or this height and diameter if made solely from a glass reinforced plastics material. The carbon fibres in the sections that use them are arranged to lie longitudinally of the mast sections since the main stress put on the mast sections when erected in a bending stress. Thus the uppermost section is constructed from material with the greatest resistance to longitudinal bending and the lowermost section from material with the least resistance, since it has sufficient strength due to its increased diameter.

The resistance to longitudinal bending of a mast section is a function of the product EI where E is Youngs Modulus and I is the second moment of area for that section. It will be appreciated that the second moment of area decreases with decreasing diameter thus reducing the resistance to longitudinal bending as the diameter decreases. Therefore, the lowermost mast section is formed from material having the lowest value for E and the uppermost section is formed from material having the highest value for E. The intermediate portions have intermediates for E. In the case of the 15 meter mast, 11 mast sections are provided. The diameters, lengths, wall thicknesses, and second moments of area of these sections are listed in Appendix A along with preferred values of E for each section, Table 1.

The top section of the mast preferably has an open top end into which an antenna support may be slotted. Alternatively, an antenna can be attached to a halyard which runs through a clip attached to a hole in the top stay plate, and hoisted to the top of an erected mast.

Figure 4:
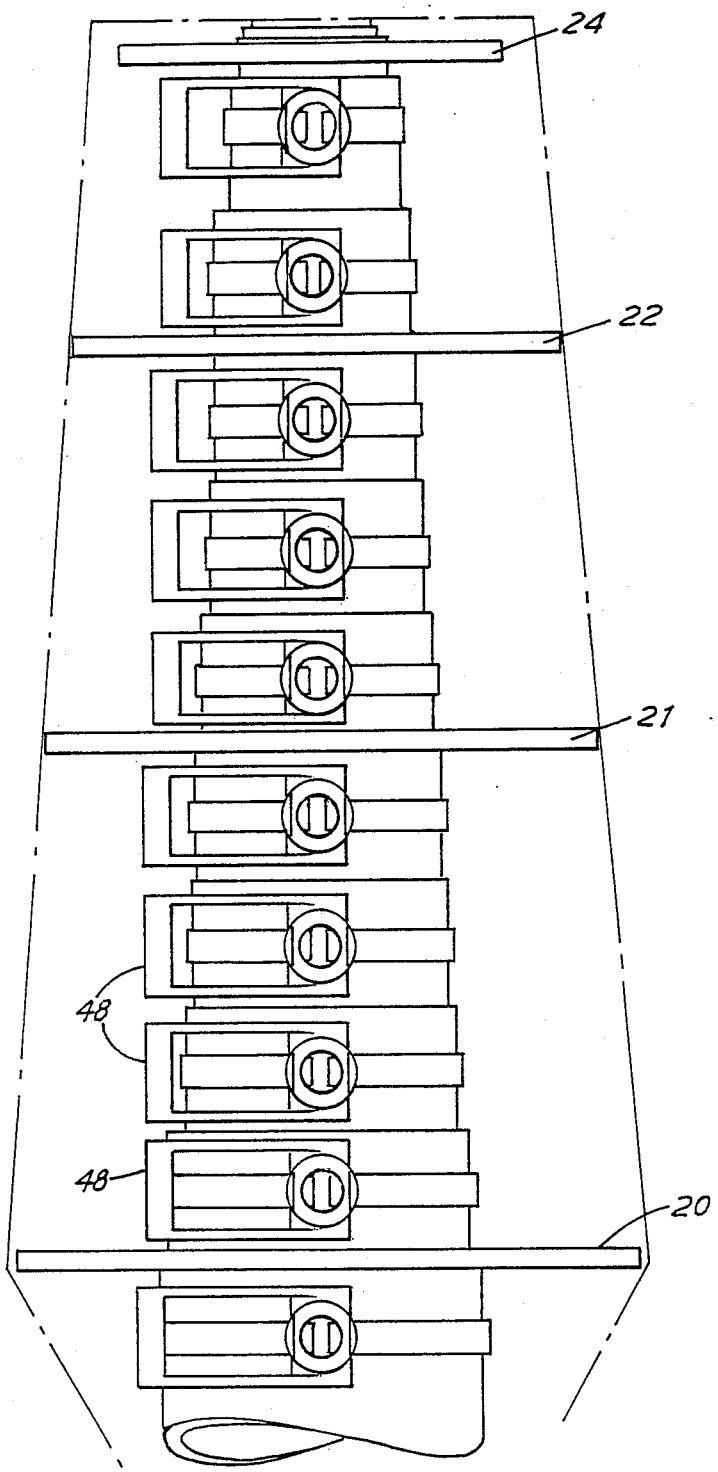
FIG. 4 shows in detail, the top section of a collapsed 15 meter mast embodying the invention.

A detail of the top secton of the collapsed 15 meter mast is shown in FIG. 4. This differs from the 12 meter mast in that there are eleven mast sections and four stay plates 20, 21, 22 and 24 which rests on the tops of the bottom, fifth, eighth and eleventh sections respectively. It can be seen in this figure that each section projects from its respective outer section to enable the clamping devices 48 to be fitted to the projection portion. This comes about through the fact that the mast sections are of increasing length from the base section to the top section and all rest on the base plate of the base section wit the mast in its collapsed state. A cross section through the base section 2 of the collapsed 15 meter mast is shown in FIG. 5 and the bottoms of all the other mast sections 3, 4, 5, 6, 8, 10, 12, 14, 16, 18, can be seen resting on the base plate 50 of the base section 2 to the left hand side or the base section as show in the figure.

Figure 5:
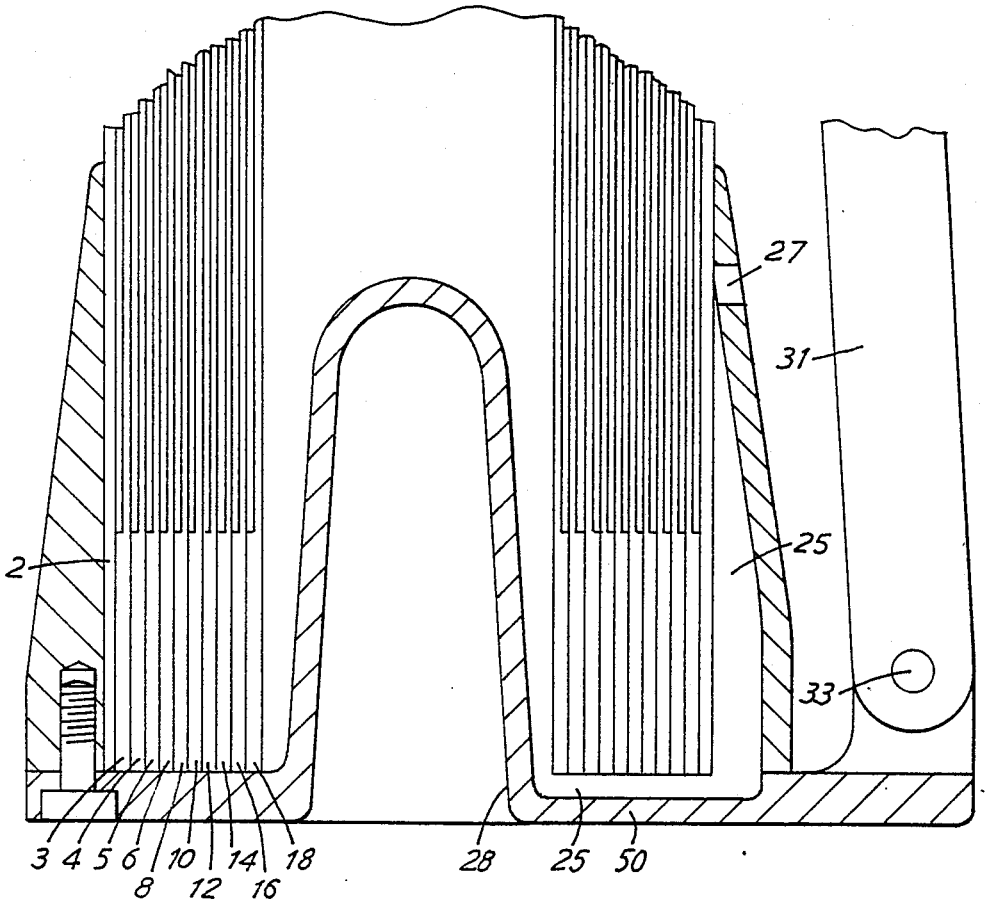
FIG. 5 shows a cross section through the base of the mast of FIG. 4.

To the right hand side of the base section shown in FIG. 5 the base plate and the bottom section of the wall are formed from thinner material and consequently the mast sections do not rest on the base plate in this region. This leaves a channel 25 running from the holow central axis of the mast to a drain hole 27 in the side of the base section. This is necessary since the axial hole 28 to receive the spike 29 is a blind hole. This drain hole 27 enables water entering the mast either through the gaps between overlapping sections or by seepage at the base of the mast to drain out. The hole is 9–10 cm above the base plate so that water will drain out even when the mast is standing on a muddy or soft surface and has sunk into the ground slightly.

The 15 meter mast also has an arm 31 attached by a hinge 33 to its base plate. This arm is about 30 cm long and has a hole (not shown) at its distal end. When the mast has been erected the arm 31 is swung downwards to lie parallel with the ground. The arm may then be used to rotate the mast to a desired orientation and hold it in position by inserting a spike through the hole at the distal end and into the ground.

Figure 7:
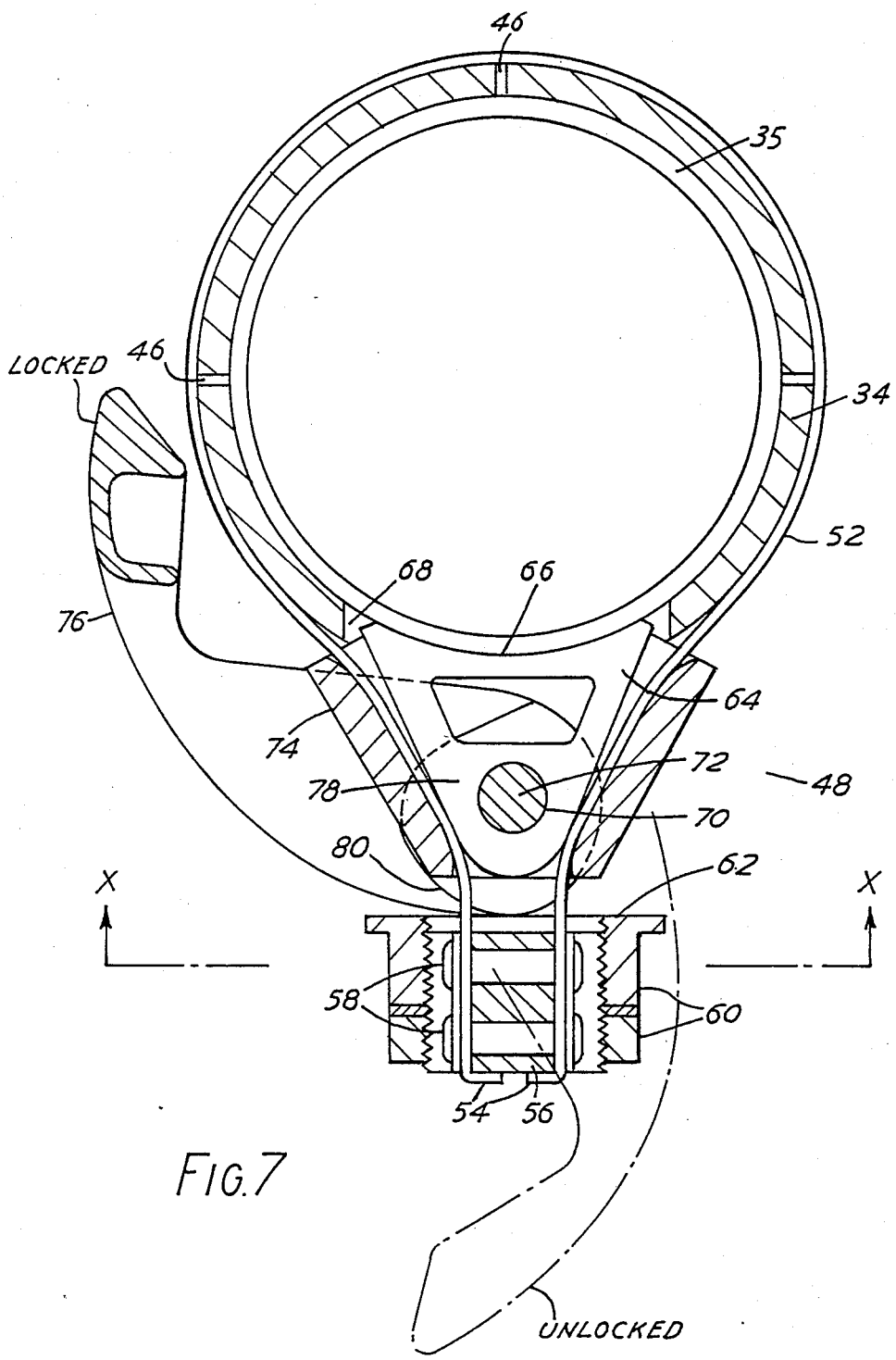
FIG. 7 shows a clamping unit in plan section.
Figure 8:
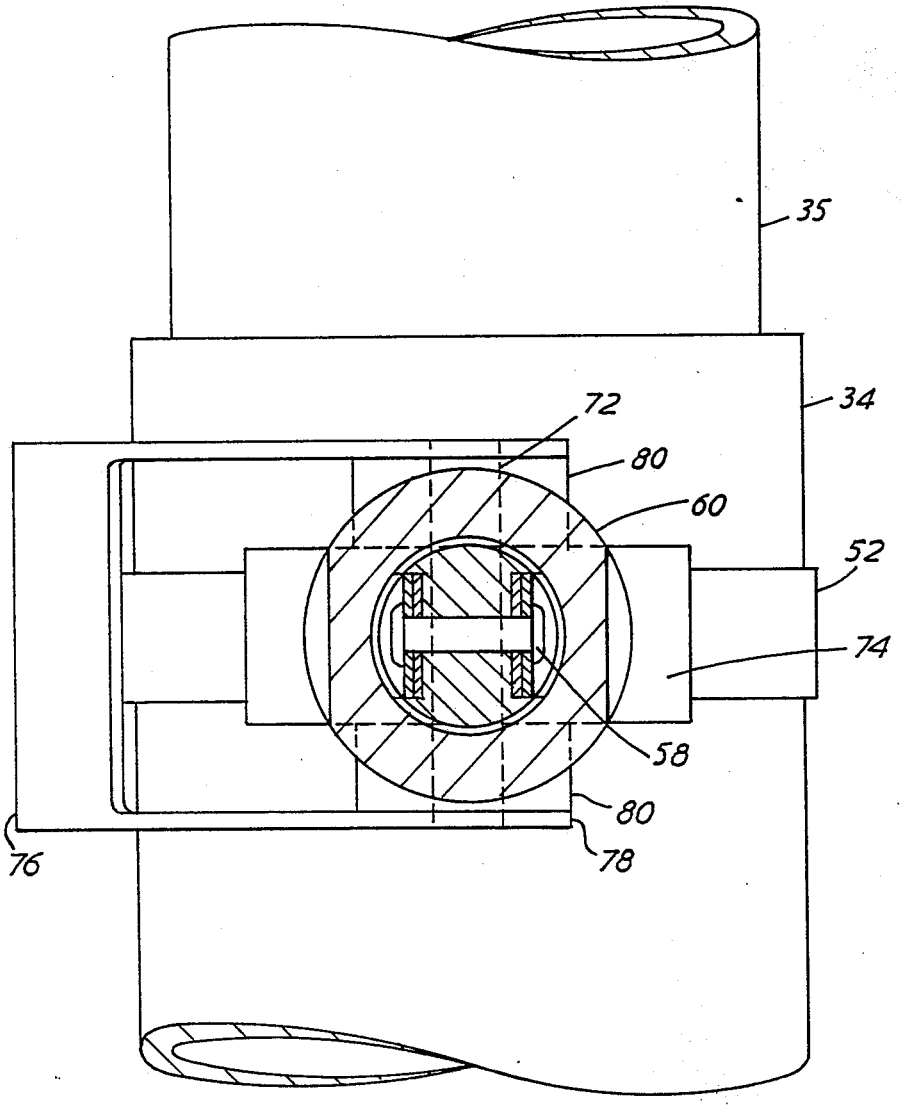
FIG. 8 shows an end view of the clamping unit of FIG. 7 along the line X—X.

At the top of each telescopic section, other than the top section, a clamping device 48 clamps the respective adjacent telescopic sections of the mast together and prevents them sliding and rotating relative to one another. As can be seen in FIG. 7 and 8, the clamping device comprise a stainless steel strap 52 around the outer 34 of the two rspective mast sections. The section 34 has three slots 46 in it to allow it to be compressed slighly in the region of the strap 52. Within the outer section 34 is the inner 35 of the two sections.

The two ends 54 of the strap are clamped tightly onto a threaded member 56 by two transverse rivets 58 and the ends 54 of the strap are bent around the end of the threaded member 56.

The threaded member is held by two locking nuts 60 one of which forms a pressure face 62, between the threaded member 56 and the two mast sections 34 and 35, the pressure face having a central hole around the strap 52. Thus the length of the strap 52, emerging through the central hole in the pressure face 62 and passing around the outer of the two mast sections, can be adjusted by altering the positions of the locking nuts 60 and the pressure face 62, relative to the threaded member 56.

Between the pressure face 62 and the two adjacent mast sections 34 and 35 is a clamp insert or abutment member 64 which has a curved face 66 which engages the inner mast section 35 through the slot 68 in the outer mast section 34.

Each mast section is of a different radius and therefore the radius of the face 66 preferably differs from each clamping unit. This radius and the length of the strap used are the only changes that need to be made to a clamping device for it to be used on a mast section of a different diameter. The clamp insert 64 also has a hole 70 through it to receive a pivot pin 72.

The clamp insert 64 and the strap 52 are enclosed in a housing 74. The housing has rectangular open ends for the strap to pass through from the mast to the threaded member 56 and locking nuts 60. The opening closest to the mast is wider than the one closest to the locking nuts, and the housing 74 is tapered between them. The top and bottom faces of the housing each have a hole through them corresponding to the hole 70 in the clamp insert 64 to receive the pivot pin 72.

A camming lever 76 is provided. The lever has a lever arm which is forked at its pivot end 78 and has two cam surfaces 80 situated one on each fork. Holes corresponding to the hole 70 in the clamp insert 64 are provided through the lever arm fork coaxial with the cam surfaces. The two cam faces are separated by a gap of the same depth as the housing 74. The caming lever 76 thus is positioned over the housing 74, the strap 52, and the clamp insert 64, and the whole assembly is fixed together with the pivot pin 72.

The assembled unit is shown in FIG. 7 with the camming lever in the locked and unlocked positions in full and broken lines respectively.

In the locked position, the cam faces80 engage on the pressure face 62. The pivot pin 72 is thus urged away from the pressure face 62. This in turn forces the clamp insert 64 against the upper mast section 35 through the slot 68 in the lower mast section and urges it away from the pressure face 62. The stainless steel strap 52 is retained in the same position relative to the pressure face by the rivets 58, and its lateral movement is restricted by the housing 74. Thus the effect of the lever arm 76 being moved to the locked position is to tighten the steel strap around the outer mast section 34. The slots 46 in the outer mast section enable the mast section to be compressed slightly and thus grip the inner mast section 35 preventing it from sliding axially or rotating.

In the unlocked position of the lever arm, the stainless steel strap is slackened and thus the outer mast section is not compressed. This enables the inner mast section 35 to slide axially. The inner mast section can thus be moved to any desired position with the lever arm 76 in the unlocked position and clamped there simply by moving the lever arm through its over-centre position to the locked position.

The components of the clamping unit are preferably all made from stainless steel so that they will not rust.

The camming lever arm 76 has a bend between its two ends, of a smaller radius that the mast section it lies against in the locked position, and the two forks of the lever extend through this bend. When the lever is in the locked position the bend is curved outwards and prevents the lever from lying too close to the mast. Thus it can be easily operated by a person wearing gloves, as would be the case if the mast were being erected in cold weather conditions.

Figure 9:
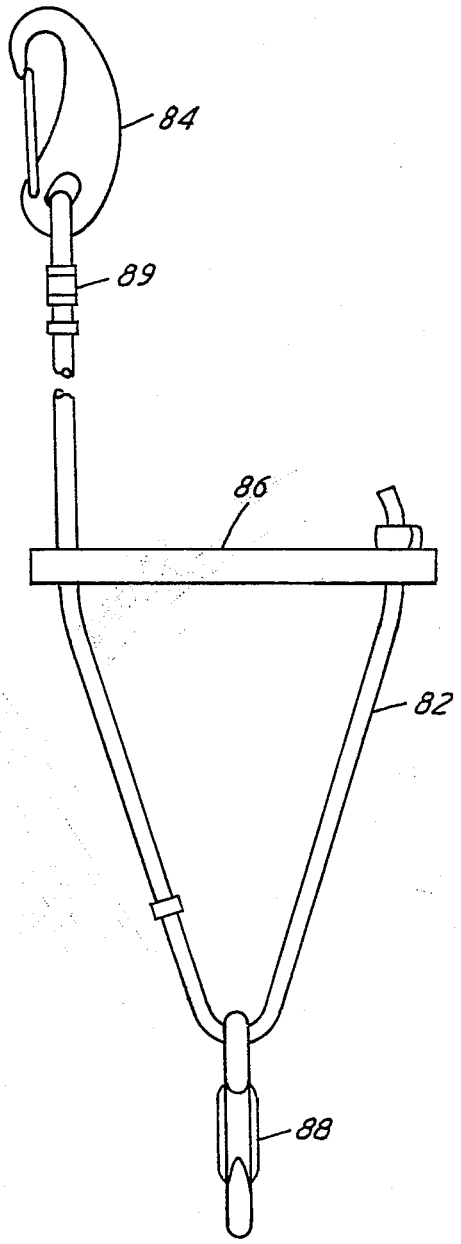
FIG. 9 shows a stay for supporting the mast.

Stays for supporting a mast are providedon reels. A stay is shown in FIG. 9 and this comprises a length of polyester or polyaramid cord 82 having a fixed hook 84 at one end of the stay. The other end of the stay is fixed to one end of a stay adjuster 86, the stay passing through a hole in the opposite end of the stay adjuster 86 between the fixed hook and the end of the stay fixed to the stay adjuster 86, thus forming a loop in the stary. This loop passes through a running hook 88; thereby allowing the stay to be tightened by means of the stay adjuster when the stay is attached, by the running hook an fixed hook, between a stay plate and a peg driven into the ground. The stays carry markers 89 which may be crimped onto the stays at at least one end of each stay. The markers are used to identify the stays, one marker being used for the first stay, two for the second stay, etc.

Figure 10:
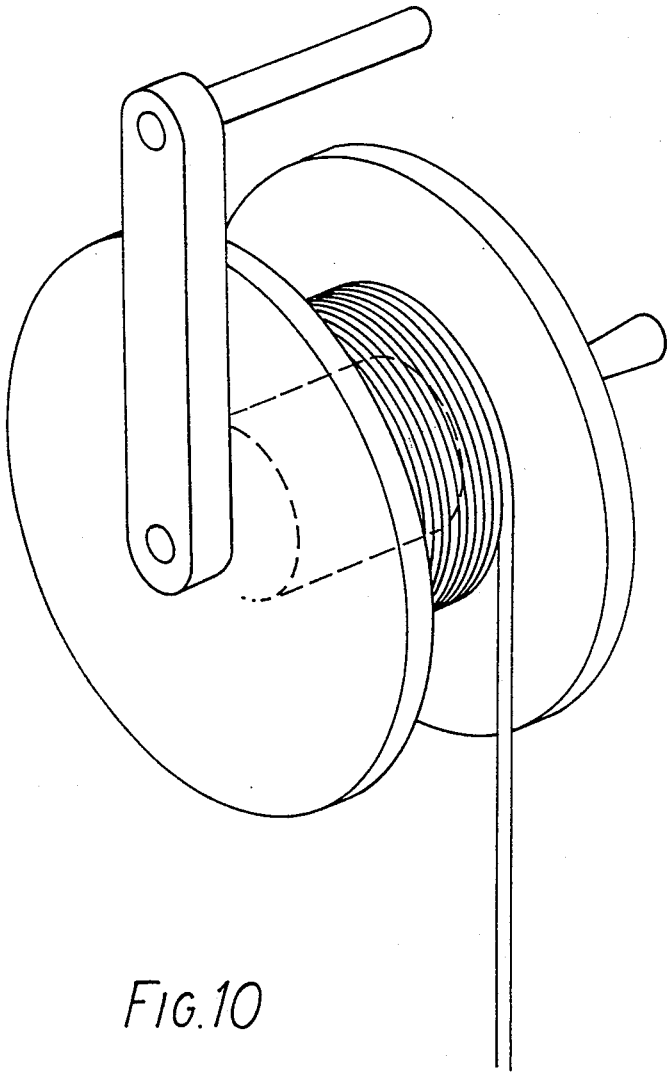
FIG. 10 shows a reel with stays wound onto it.

A reel with stays wound onto it is shown in FIG. 10. For both the 15 meter k and the 12 meter mast the order in which the stays are wound onto the reel is important. For the 12 meter mast two reels are used with stays wound on in the following order:

Reel 1: The halyard is wound onto the reel starting with the fixed hook. The fixed hook of one of the third stays is clipped to the running hook of the halyard and wound onto the reel. The running hook of one of the secondstays is fixed to the running hook of the third stay and wound onto the reel. This is repeated with another third stay and second stay.

Figure 11:
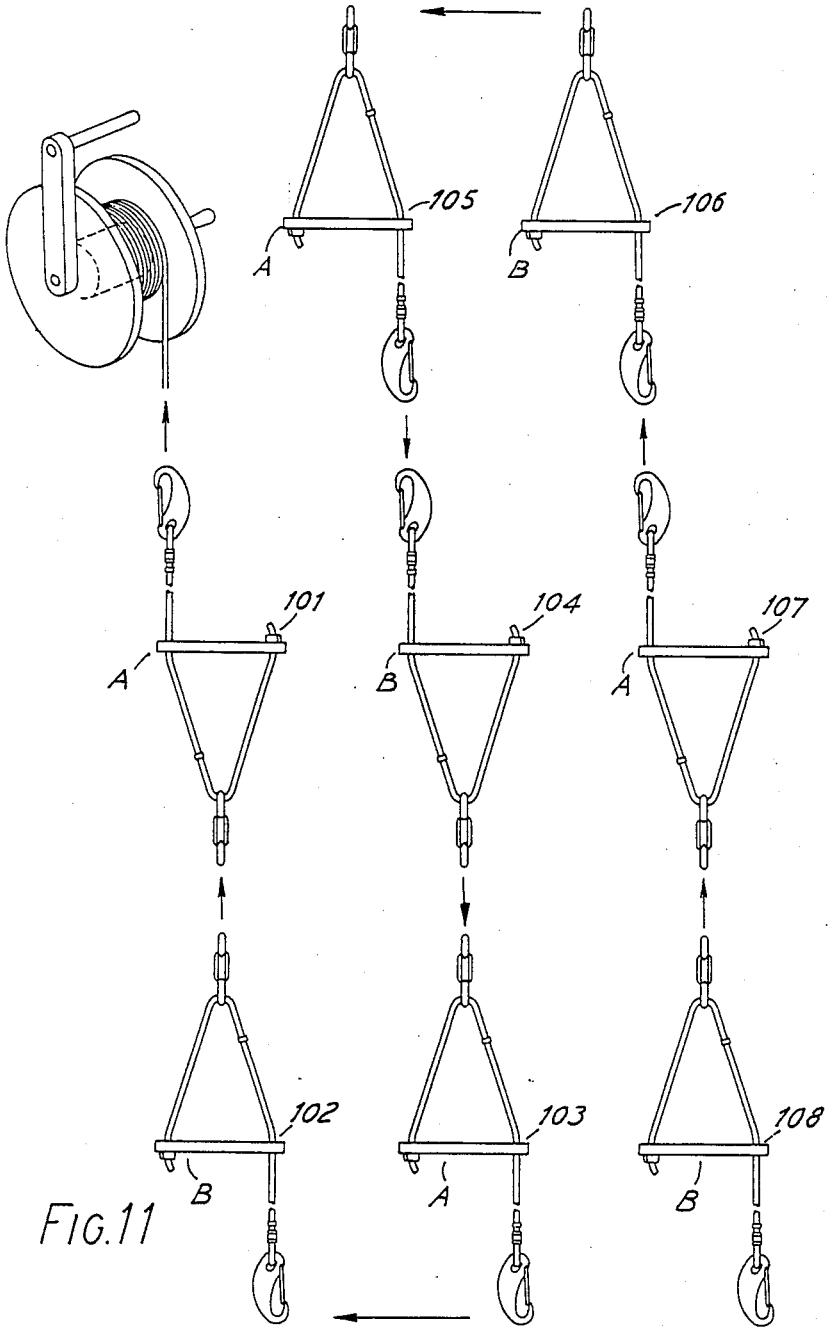
FIG. 11 shows the reel of FIG. 10 with two sets of stays in the order in which they are to be wound on the reel.

Reel 2: The fixed hook of a third stay is fixed to the reel and the stay wound on. The running hook of a second stay is fixed to the running hook of the third stay and the stay wound on. This is repeated for the remaining third and second stays. The running hook of one of the first stays is clipped to the fixed hook of the last wound second stay. This is repeated for the other three first stays with the running hook of each end stay being attached to the fixed hook of the last wound stay. The order of winding of the second and third stays is illustrated in FIG. 11. The third set of stays is identified by the letter B and the second set by the letter A. The stays are numbered in the order in which they are wound onto the reels from 101 to 108. Stays 101–104 are wound onto reel 1 and stays 105–108 are wound onto reel 2. Arrows indicate the ends of each stay which are wound innermost on reels.

Figure 6:
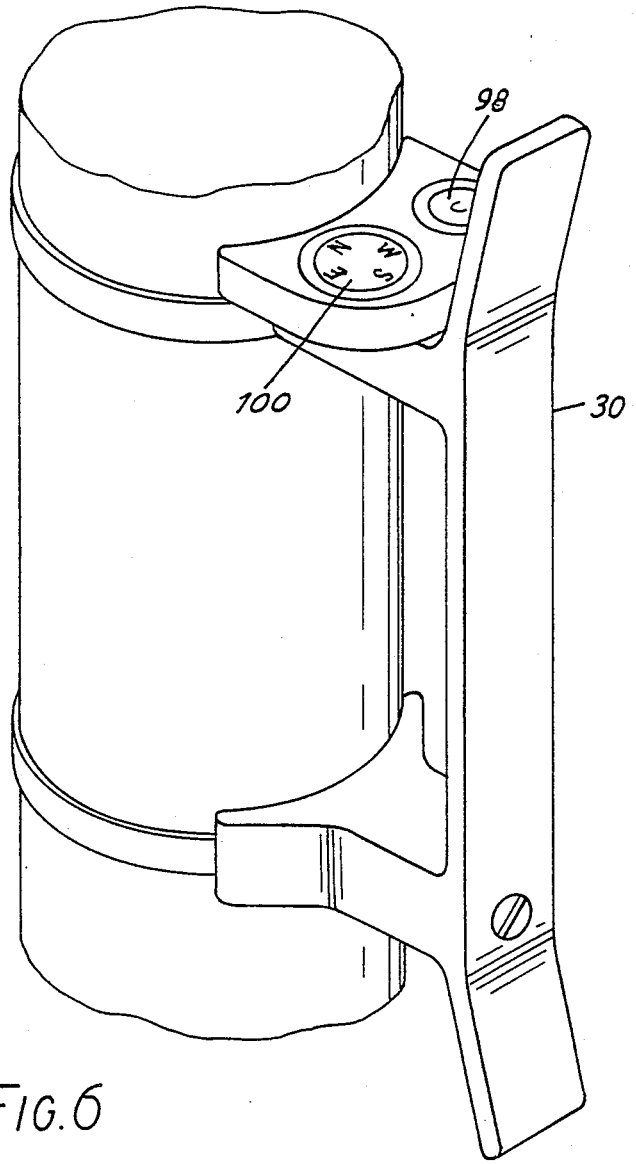
FIG. 6 shows a detail of the handle for carrying the mast.

To erect the 12 meter mast, a spike 29 is first driven into the ground on the spot where the mast is to stand. Four pegs 96 are driven into the ground in a circle around the spike 29, at 90° intervals approximately one meter from the spike 29. The four first stays on reel 2 provided each have a fixed hook at one end and a running hook at the other end to enable the length of the stay to be adjusted. The four first stays are unwound and the fixed hooks are attached to respective pegs. The retracted mast is place on the spike 29 and the running hooks of the first stays are clipped to respective holes in the lower stay plate 20. The stays are then adjusted until the mast is vertical, this being achieved by the use of a spirit level 98 built into the handle 30 of the mast, as shown in FIG. 6.

Next, the fixed hook of a second stay, which is the next available stay on reel 2 is clipped to a hole in the central stay plate 22. A peg 96 is driven into the ground approximately 8 m away from the mast this location being reached by walking whilst unwinding the stay from reel 2, this distance being indicated by the marker 89 on the stay. The running hook of the second stay is attached to the peg, as is the running hook of the third stay which is the next available on reel 2. The mast is then walked back to whilst unwinding the third stay and the fixed hook of the third stay is then attached to the top stay plate 24. This process is repeated for the remaining second and third stays on reel 2 and the two second and third stays wound on reel 1, at 90° intervals around the mast. The running hook of the halyard on reel 1 is then attached to the top stay plate 24.

The mast then looks as in FIG. 1, being held vertical by the first four stays. The second and third stays and are attached in positin but are of course very slack; they are shown in FIG. 1 very much tauter than they will in fact be for clarity. The uppermost clamping unit is then released and the top section of the mast is pushed up and locked in position by the clamping unit. This process continues until the mast is fully extended.

The mast is then set vertical by adjusting the second and third stays, care being taken not to overtension the mast. The mast may then be rotated to any desired orientation by using a compass 100 which is also buolt into the handle 30. This is possible because the stay plates are rotatable. It may be necessary to slightly reduce the tension in the stays to rotate the mast.

It is important that the mast is collapsed and the stays wound back onto the reels in the reverse of the above order. The markers on the stays may be crimped toggles at at least one end of each stay to aid identification of the stays. The first set of stays would each have one toggle, the second set two toggles and the third set three toggles. This aids identification of stays when the mast is being erected in the dark.

The running hooks of the second and third stays may be replaced by a common running hook. Thus only one hook has to be clipped to each of the outer set of stays.

By using this method of winding the stays onto the reels, the described method of erection is possible and the amount of walking between the mast and the pegs is minimised since for the second set of pegs it is only necessary to walk between the mast and the pegs and not between the pegs. In particular this arises because the stays other than the lowest set are wound with stays of two adjacent sets alternating. It will be appreciated that in fact the lowermost ends of the second and third stays can be permanently joined together. The described method and the fact that the lowermot stay plate is attached to the lowermost section of the mast enable of the mast enable the mast to be erected by one person.

The purpose of the halyard is to hoist an antenna to the top of the mast once it has been erected. The handle of the mast acts as a cleat to secure the halyard to once the antenna has been hoisted to the top of the mast. Alternatively, an antenna may be securely fixed to the top of the mast prior to erection e.g. mounted on a port extending into the topmost section. This is particularly appropriate where a directional antenna is being used since accurate angular adjustment of the antenna will be necessary. The compass 100 provided in the handle of the mast and the rotatable stay plates enable the whole erected mast to be rotated whilst supported.

If one of the mast sections should become partially damaged then the mast may still be used. The base plate may be removed, and the clamping devices removed from each section. The sections can then slide out of the bottom of the mast. The damaged portion of a section can be cut off and the remaining portion used. If the lower portion of a mast section is cut off the elongate flange will have been removed and care will have to be taken to leave an overlap between sections when erecting the mast. If the upper portion is removed then it will be necessary to cut a slot for the clamping device to engage the inner mast section and slits will have to be cut to aid compression of the section. A whole section can be omitted and a short strip put in its place. This is clamped onto by the outer section and in turn is compressed and clamps the next inner section.

The 15 meter mast comprises eleven concentric mast sections and has four stay plates to which four sets of stays are attached. These stays are attached to three sets of pegs. The first set of stays are attached to the inner set of pegs, the second and third sets of stays to the middle set of pegs, and the fourth set of stays to the outer set of pegs.

This 15 meter mast is preferably erected by two people and the stays are provided on four reels. Each reel has the same order of stays wound upon it as follows:

Reel for 15 m mast: The running hook of a fourth stay is fixed to the reel and the stay wound onto the reel. The fixed hook of a third stay is fixed to the fixed hook of the fourth stay and the third stay wound onto the reel. The running hook of a second stay is fixed to the running hook of the third stay and the second stay wound onto the reel. The fixed hook of a first stay is fixed to the fixed hook of the second stay and the first stay wound onto the reel. The same process is repeated for the remaining three reels.

It will be appreciated that with four reels wound as described above the persons erecting the mast need only walk between the mast and three sets of four pegs driven into the ground at 90° intervals around the mast. Thus the amount of walking necessary when erecting the mast is minimised.

Appendix A

TABLE 1

| Tube No. | Length mm | Diameter mm | Wall Thickness mm | I (2nd Moment of Area) | E (Young's Modulus) $MN/m^2$ |
|---|---|---|---|---|---|
| 1 | 1298 | 100.5 | 2.5 | 1.153 | 32.96 |
| 2 | 1345 | 95.5 | 2.5 | 0.987 | 32.96 |
| 3 | 1387 | 90.5 | 2.5 | 0.838 | 39.02 |
| 4 | 1429 | 85.5 | 2.5 | 0.705 | 45.16 |
| 5 | 1471 | 80.5 | 2.5 | 0.587 | 45.16 |
| 6 | 1518 | 75.5 | 2.5 | 0.482 | 45.16 |
| 7 | 1560 | 70.5 | 2.5 | 0.391 | 51.23 |
| 8 | 1602 | 65.5 | 2.5 | 0.313 | 51.23 |
| 9 | 1649 | 60.5 | 2.5 | 0.245 | 51.23 |
| 10 | 1691 | 55.5 | 2.5 | 0.188 | 57.98 |
| 11 | 1696 | 50.5 | 2.5 | 0.191 | 57.98 |

We claim:

1. A method of erecting a telescopic mast having a plurality of concentric, relatively slidable sections, a plurality of stay fixing means which, when the mast is extended, are spaced longitudinally from one another with one being located at the top of the lowermost section, and a plurality of sets of stays, the stays of each set being secured at one end to a respective one of the stay fixing means and at their other ends to a plurality of sets of fixing locations each one of a set of stay fixing locations being substantially equidistant from and equiangular about the foot of the mast the sets being substantially concentric one within the other; the method comprising the steps of:

(a) attaching the lowermost stays to the innermost set of fixing locations and to the lowermost stay fixing means;

(b) adjusting the lowermost stays to hold the telescoped sections of the mast in a substantially vertical position;

(c) securing one of the next adjacent set of stays to the next adjacent stay fixing means and to one of the next adjacent set of fixing locations and securing the next adjacent stay to the same fixing location and to the stay fixing means following said next adjacent stay fixing means;

(d) repeating step (c) until all next adjacent sets of stays are secured;

(e) extending the mast in a substantially vertical direction.

2. A method of winding stays for use in erecting a telescopic mast having at least three sets of stays, comprising winding stays sequentially on one or more winding reels, in which at least some of the stays other than the stay of the lowermost set of stays are wound with stays of two adjacent sets alternating, one of the adjacent sets being wound each stay with an end innermost on the reel for attachment to a stay fixing location and the other set being wound each stay with an end outermost on the reel for attachment to the said stay fixing location.

3. A reel carrying winding stays for use in erecting a telescopic mast having at least three sets of stays, the reel having a plurality of stays wound sequentially thereon and carrying stays of two adjacent sets of stays other than the lowermost set, alternately on the reel, one of the adjacent sets being wound each stay with an end innermost on the reel for attachment to a stay fixing location and the other set being wound each stay with an end outermost on the reel for attachment to the said stay fixing location.

4. A kit for erecting a telescopic mast comprising stays including stays wound on a reel in accordance with claim 3, and a telescopic mast having a plurality of concentric relatively slidable sections with at least three sections carrying stay fixing means at their top ends, one of the said three sections being the lowermost section.

* * * * *